US007600407B2

(12) United States Patent
Nguyen

(10) Patent No.: US 7,600,407 B2
(45) Date of Patent: Oct. 13, 2009

(54) STAKE PUNCH

(75) Inventor: Hong Wai Nguyen, Troy, MI (US)

(73) Assignee: GM Global Technology Operations, Inc., Detroit, MI (US)

( * ) Notice: Subject to any disclaimer, the term of this patent is extended or adjusted under 35 U.S.C. 154(b) by 185 days.

(21) Appl. No.: 11/734,840

(22) Filed: Apr. 13, 2007

(65) Prior Publication Data

US 2008/0250841 A1 Oct. 16, 2008

(51) Int. Cl.
*B21D 31/02* (2006.01)

(52) U.S. Cl. ..... 72/325; 72/476; 29/512

(58) Field of Classification Search ..... 72/325, 72/326, 327, 462, 476; 470/63; 29/512, 29/515, 522.1, 523, 525
See application file for complete search history.

(56) References Cited

U.S. PATENT DOCUMENTS 3,269,168 A * 8/1966 Anderson ..... 72/412
3,685,336 A * 8/1972 Black, Jr. ..... 72/325
3,728,892 A * 4/1973 Sangster ..... 72/476
4,133,091 A * 1/1979 Ito ..... 29/33 K
4,670,927 A * 6/1987 Vaughn ..... 470/9
5,140,735 A * 8/1992 Ladouceur ..... 29/243.522
5,174,018 A * 12/1992 Muller ..... 29/798
5,291,772 A * 3/1994 Ferraro ..... 72/476
5,934,135 A * 8/1999 Webster ..... 72/359
6,195,875 B1 * 3/2001 Neuenschwander ..... 29/732
6,651,479 B2 * 11/2003 Ratte ..... 72/476

* cited by examiner

*Primary Examiner*—Edward Tolan

(57) ABSTRACT

A stake punch for securing a pin in a gearset is provided. The stake punch includes a body defining an axis and a punch extending from the body along the axis. The punch includes a pair of opposing top and bottom surfaces, an end face, and a pair of stake faces each connected to the end face. The stake faces each have a curved surface extending between the top surface and bottom surface. The curved surface has a constant radius of curvature along a length of the stake face. The pair of stake faces are at an angle with respect to the axis.

14 Claims, 3 Drawing Sheets

STAKE PUNCH

FIELD

The present disclosure relates to stake punches, and more particularly to a stake punch used to retain a pin in a planetary carrier assembly.

BACKGROUND

The statements in this section merely provide background information related to the present disclosure and may or may not constitute prior art.

A typical planetary gear assembly includes a carrier that supports at least one pinion pin. A pinion gear is rotatably mounted on the pinion pin and engages a ring gear and a sun gear. In the process of assembling the typical planetary gear assembly, the pinion pin is pressed into a pinion pin hole located in the carrier. The pin is then staked at both ends by a stake punch. This staking process involves plasticly deforming the relatively soft region at the ends of the pin using the stake punch to restrain the pin from sliding and rotating relative to the carrier. In addition, the staked pin is required to remain in place when subjected to specified axial forces. Since staking involves plastic deformation of the pin, a relatively high stake force is required. However, a high stake force can also lead to undesired stresses and distortion of the pin and carrier as well as a reduced life of the staking tool. This is especially critical for hollow pinion pins.

Accordingly, stake punches have been designed to attempt to maximize retention forces while minimizing undesired stresses and pin distortion. Typical stake punches can generally include a stake face that is either flat, spherical, or conical, While useful for their intended purpose, there is room in the art for an improved stake punch that maximizes retention forces while minimizing undesired stresses and pin distortion.

SUMMARY

The present invention provides a stake punch for securing a pin in a gearset. The stake punch includes a body defining an axis and a punch extending from the body along the axis. The punch includes a pair of opposing top and bottom surfaces, an end face, and a pair of stake faces each connected to the end face. The stake faces each have a curved surface extending between the top surface and bottom surface. The curved surface has a constant radius of curvature along the stake face. The pair of stake faces are at an angle with respect to the axis.

In one aspect of the present invention the radius of curvature of the stake faces is approximately equal to an inner radius of the pin.

In another aspect of the present invention the angle is between 45 degrees and 70 degrees.

In yet another aspect of the present invention the end face has a length greater than a length of each of the stake faces.

In yet another aspect of the present invention the punch further includes a pair of opposing side walls extending from the body, the stake faces extending between the side walls and the end face.

In yet another aspect of the present invention the punch further includes beveled surfaces between each of the top surface, bottom surface, pair of stake faces, end face, and pair of side walls.

The present invention also provides an assembly having a pin having an annular ring with a first inner radius at an end of the annular ring. The assembly includes a stake punch for deforming a portion of the annular ring of the pin. The stake punch has a body defining an axis and a punch extending from the body. The punch includes a pair of opposing top and bottom surfaces, an end face, and a pair of stake faces each connected to the end face. The stake faces each have a curved surface. The curved surfaces each have a radius of curvature equal to the first inner radius of the annular ring of the pin.

In another aspect of the present invention the arc of curvature of the stake faces is constant along a length of the stake faces.

In yet another aspect of the present invention the pair of stake faces are at an angle with respect to the axis.

In yet another aspect of the present invention the angle is between 45 degrees and 70 degrees.

In yet another aspect of the present invention the end face has a length greater than the length of each of the stake faces.

In yet another aspect of the present invention the punch further includes a pair of opposing side walls extending from the body, the stake faces extending between the side walls and the end face.

In yet another aspect of the present invention the punch further includes beveled surfaces between each of the top surface, bottom surface, pair of stake faces, end face, and pair of side walls.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

DETAILED DESCRIPTION

The following description is merely exemplary in nature and is not intended to limit the present disclosure, application, or uses.

Figure 1:
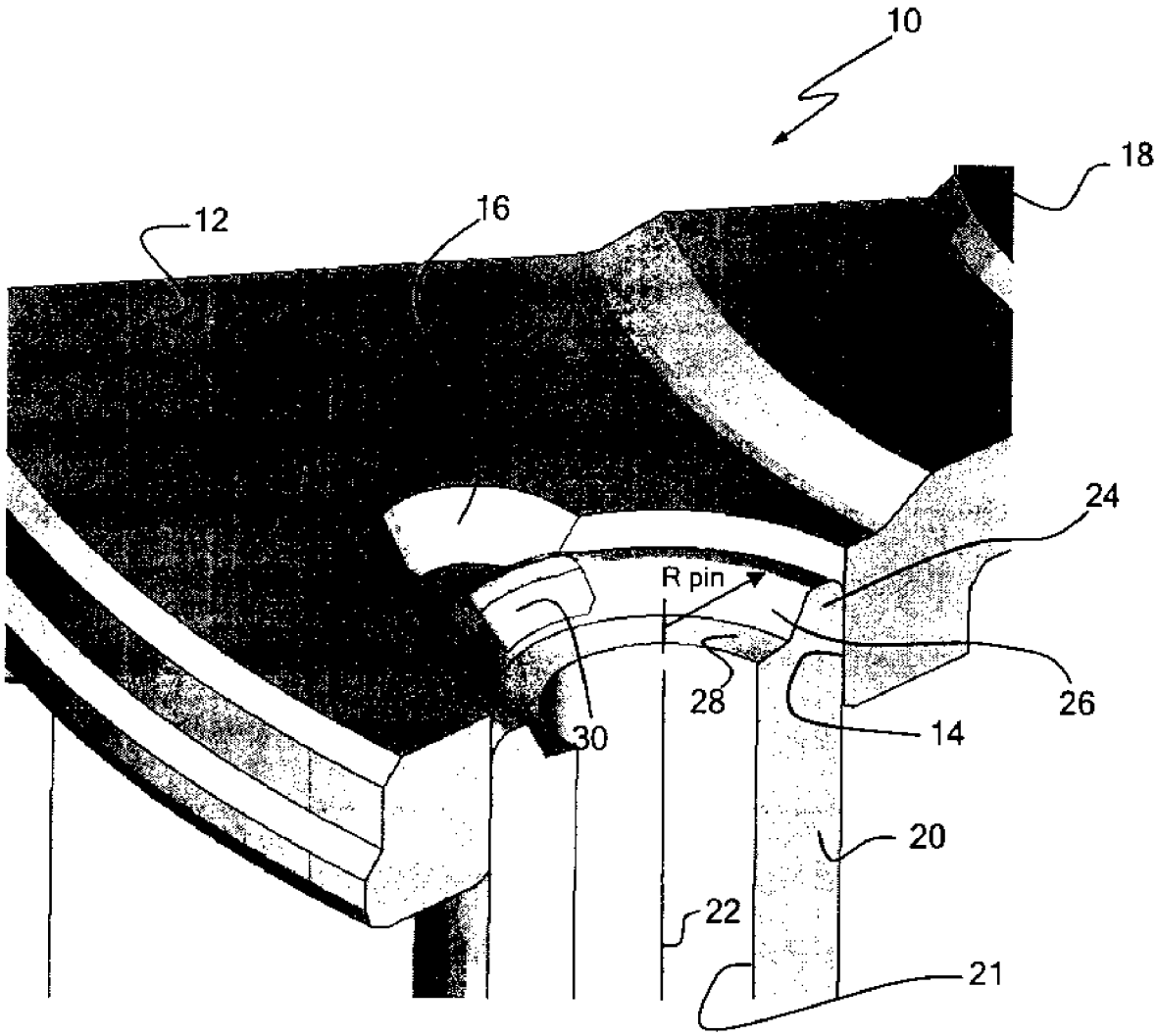
FIG. 1 is an isometric view of a portion of an exemplary planetary gear assembled using a stake punch according to the principles of the present invention.

With reference to FIG. 1, a portion of an exemplary planetary gear assembly is indicated by reference number 10. The planetary gear assembly 10 may be a simple planetary gear having a ring gear and sun gear, or may take various other forms such as a compound planetary gear assembly. The planetary gear assembly 10 generally includes a planetary carrier 12 that defines at least one pin hole 14. The pin hole 14 extends from one side of the planetary carrier 12 through to an opposite side of the planetary carrier 12. While only one pin hole 14 has been illustrated, it should be appreciated that the planetary carrier 12 may include any number of pin holes 14. At least one anti-rotation pocket 16 is formed on the planetary carrier 12 adjacent the pin hole 14. The anti-rotation pocket 16 extends from the pin hole 14 into the planetary carrier 12. Preferably a second recess (not shown) is formed opposite the anti-rotation pocket 16. The planetary carrier 12 includes a hub 18 that is connectable to a shaft (not shown).

The planetary carrier 12 further includes a pinion pin 20 supported within the pin hole 14. The pinion pin 20 is illustrated as a hollow pinion pin that defines an inner bore 21, but it should be appreciated that the pinion pin 20 may take various forms without departing from the scope of the present invention. The pinion pin 20 is operable to support for rotation a pinion gear (not shown). The pinion pin 20 is generally cylindrical and defines an axis indicated by reference number 22. An annulus or ring 24 is located on an end of the pinion pin 20. The annulus 24 has a curved inner face 26. An annular end surface 28 extends from the curved inner face 26 to the inner bore 21. The annulus 24 has a radius defined as the distance from the axis 22 to the end of the surface of the oblique or curved inner face 26, indicated by the designation "$R_{pin}$" in FIG. 1. As will be described in greater detail below, the annulus 24 is radially outwardly deformed in a portion 30 such that the portion 30 at least partially fits within the anti-rotation pocket 16.

Figure 2A:
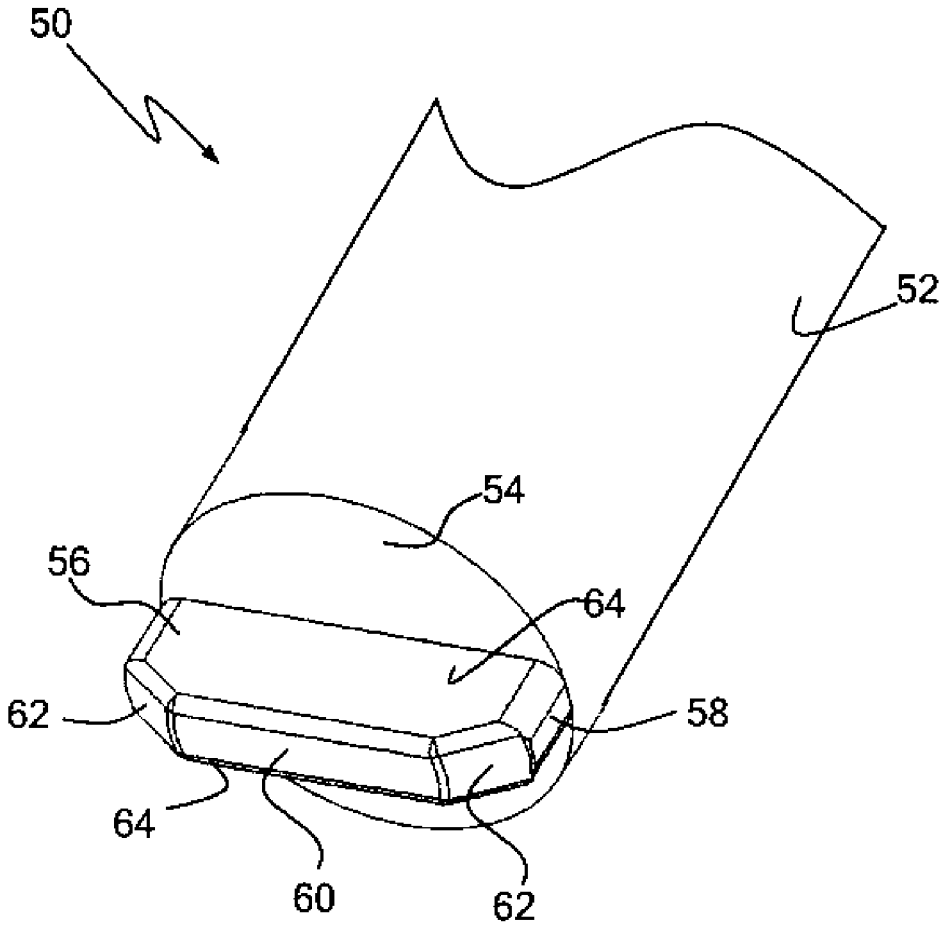
FIG. 2A is an isometric view of the stake punch of the present invention.
Figure 2B:
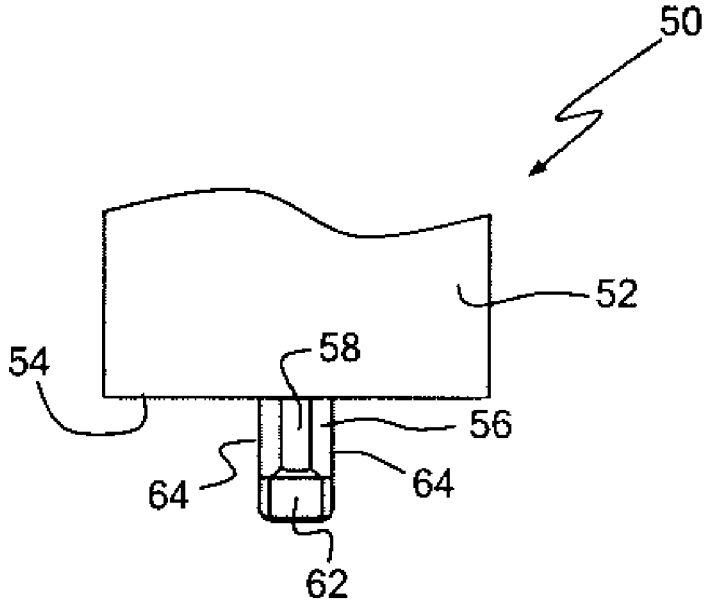
FIG. 2B is a side view of the stake punch of the present invention.
Figure 2C:
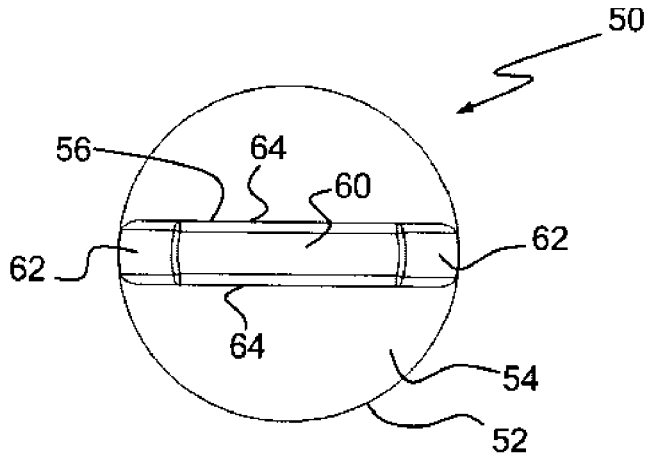
FIG. 2C is an end view of the stake punch of the present invention.

With combined reference to FIGS. 2A-C, a stake punch is shown and generally indicated by reference number 50. The stake punch 50 is operable to radially outwardly deform the portion 30 of the annulus 24 (FIG. 1). The stake punch 50 includes a cylindrical body 52 having a flat end 54. It should be appreciated that the end 54 may take various other shapes without departing from the scope of the present invention. A stake 56 extends out from the flat end 54 of the cylindrical body 52.

The stake 56 is generally planar and extends across the diameter of the cylindrical body 52. The stake 56 includes a pair of side walls 58 and an end face 60. It should be appreciated that the stake 56 may not include the side walls 58 without departing from the scope of the present invention. A pair of stake faces 62 extend between the side walls 58 and the end face 60. In the example provided, the stake faces 62 have a length less than a length of the end face 60, though it should be appreciated that the length of the stake face 62 is dependent on the height of the annulus 26 (FIG. 1). The pair of side walls 58, the pair of stake faces 62, and the end face 60 connect with a pair of surfaces 64 that define the top and bottom of the stake 50. In the particular example provided, the edges between the side walls 58, stake faces 62, end face 60, and surfaces 64 are all beveled. However, it should be appreciated that the edges may be formed having sharp edges or rounded edges without departing from the scope of the present invention.

Figure 2D:
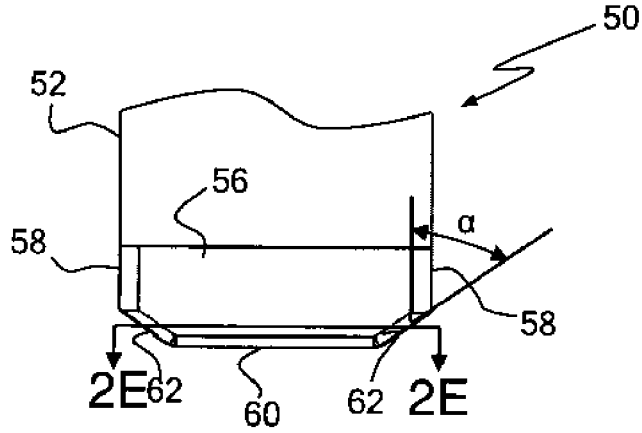
FIG. 2D is a top view of the stake punch of the present invention.

Turning now to FIG. 2D, the stake faces 62 are at an angle with respect to the side walls 58, as indicated by the designation "$\alpha$". In the preferred embodiment, the angle $\alpha$ is between 45 degrees and 70 degrees. However, it should be appreciated that the angle $\alpha$ may vary outside of the preferred range without departing from the scope of the present invention.

Figure 2E:
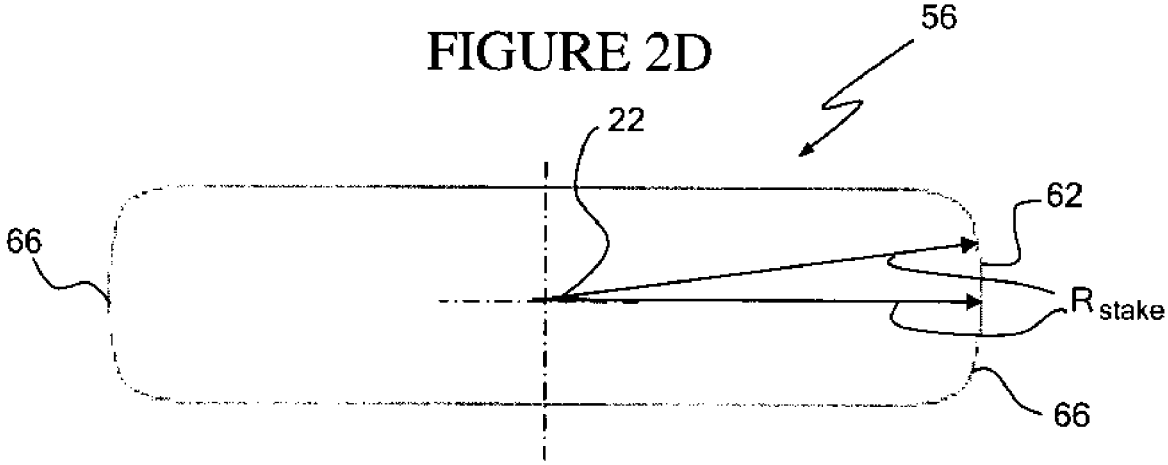
FIG. 2E is an enlarged cross-sectional view of the stake punch of the present invention taken in the direction of arrows 2E-2E in FIG. 2D.

The stake faces 62 have a curved outer surface 66 as best seen in the cross-sectional view shown in FIG. 2E. The curved surfaces 66 extend between the surfaces 64. The curved surfaces 66 of the stake faces 62 have a radius of curvature as indicated by the designation "$R_{stake}$". $R_{stake}$ is equal to $R_{pin}$ FIG. 1). As noted above, $R_{pin}$ is the radius of the pin 20 at the top of the curved inner surface 26, which is a constant value for any given pin. The radius $R_{stake}$ of the stake faces 62 is constant and does not change along the length of the stake faces 62. In other words, the stake faces 62 have a curved surface 66 having a radius equal to $R_{pin}$ at any cross-section through the stake faces 62. At the cross-section shown in FIG. 2E, the radius $R_{stake}$ has a center point that falls on the axis 22, however, since $R_{stake}$ is constant, for any given cross-section the center point falls on an axis having an angle $\alpha$ relative to the axis 22.

During the staking process, the sloped faces 62 are aligned with the anti-rotation pocket 16. The stake punch 50 is then driven towards the pinion pin 20 such that the punch 56 engages the annulus 24 of the pinion pin 20. The stake punch 50 is driven to a specified stake depth relative to the pinion pin 20. As the stake punch 50 is driven towards the pinion pin 20, the sloped faces 62 push against the annulus 24 and deform the portion 30 into the anti-rotation pocket 16. The size of the portion 30 (i.e. the amount of material of the annulus 24) deformed into the anti-rotation pocket 16 determines the retention force between the pinion pin 20 and the carrier 12. By employing a stake face 62 as described in the present invention, stress on the stake punch 50 during the staking process is reduced to levels lower than found on previous stake punch designs. Additionally, a larger and more uniform portion 30 (i.e. a greater uniform amount of material of the annulus 24) is deformed into the anti-rotation pocket 16 for a given stake depth than found in previous stake punch designs.

The description of the invention is merely exemplary in nature and variations that do not depart from the gist of the invention are intended to be within the scope of the invention. Such variations are not to be regarded as a departure from the spirit and scope of the invention.

What is claimed is:

1. A stake punch for securing a pin in a gearset, the stake punch comprising:
- a body defining an axis; and
- a punch extending from the body along the axis, the punch having:
  - a pair of opposing top and bottom surfaces;
  - an end face; and
  - a pair of stake faces each connected to the end face and each having a curved surface extending between the top surface and bottom surface, the curved surface having a constant radius of curvature along an arc that connects the top surface to the bottom surface, and the curved surface having a constant radius of curvature along a length of the stake face;
  - wherein the pair of stake faces are at an angle with respect to the axis.

2. The stake punch of claim 1 wherein the radius of curvature of the stake faces is approximately equal to an inner radius of the pin at an end surface of the pin.

3. The stake punch of claim 2 wherein the angle is between 45 degrees and 70 degrees.

4. The stake punch of claim 3 wherein the end face has a length greater than the length of each of the stake faces.

5. The stake punch of claim 4 wherein the punch further includes a pair of opposing side walls extending from the body, the stake faces extending between the side walls and the end face.

6. The stake punch of claim 5 further comprising beveled surfaces between each of the top surface, bottom surface, pair of stake faces, end face, and pair of side walls.

7. An assembly comprising:
- a pin defining a first radius at an end of the pin, wherein the pin includes an annulus, and the first radius is measured from an axis defined by the pin to an inner surface of the annulus at an end of the annulus;
- a stake punch for deforming a portion of the pin, the stake punch having a body and a punch extending from the body, the punch having:

a pair of opposing top and bottom surfaces;

an end face; and a pair of stake faces each connected to the end face and each having a curved surface, the curved surfaces each having a radius of curvature equal to the first radius of the pin.

8. The assembly of claim 7 wherein the radius of curvature of the stake faces is constant along a length of the stake faces.

9. The assembly of claim 7 wherein the pair of stake faces are at an angle with respect to an axis defined by the body.

10. The assembly of claim 9 wherein the angle is between 45 degrees and 70 degrees.

11. The assembly of claim 10 wherein the end face has a length greater than the length of each of the stake faces.

12. The assembly of claim 11 wherein the punch further includes a pair of opposing side walls extending from the body, the stake faces extending between the side walls and the end face.

13. The assembly of claim 12 further comprising beveled surfaces between each of the top surface, bottom surface, pair of stake faces, end face, and pair of side walls.

14. The assembly of claim 9 wherein the angle is constant.

* * * * *